United States Patent [19]

Baker et al.

[11] Patent Number: 5,038,683

[45] Date of Patent: Aug. 13, 1991

[54] HIGH EXPLOSIVE ASSEMBLY FOR PROJECTING HIGH VELOCITY LONG RODS

[75] Inventors: Ernest L. Baker, Vernon; Pai-Lien Lu, Rockaway; Brian Fuchs, Hackettstown; Barry Fishburn, Rockaway, all of N.J.

[73] Assignee: The United States of America as represented by the Secretary of the Army, Washington, D.C.

[21] Appl. No.: 401,191

[22] Filed: Aug. 31, 1989

[51] Int. Cl.[5] ..... F42B 1/02

[52] U.S. Cl. ..... 102/308; 102/310; 102/476; 102/501

[58] Field of Search ..... 102/307, 308, 310, 476, 102/501

[56] References Cited

U.S. PATENT DOCUMENTS

| | | | |
|---|---|---|---|
| 3,561,361 | 2/1971 | Kessenich | 102/24 |
| 4,170,940 | 10/1979 | Precoul | 102/56 SC |
| 4,466,353 | 8/1984 | Grace | 102/307 |
| 4,627,353 | 12/1986 | Chawla | 102/307 |
| 4,665,826 | 5/1987 | Marer | 102/476 X |
| 4,669,384 | 6/1987 | Chawla et al. | 102/307 |

*Primary Examiner*—Peter A. Nelson

*Attorney, Agent, or Firm*—Robert P. Gibson; Edward Goldberg; Michael C. Sachs

[57] ABSTRACT

A high explosive assembly and a method are disclosed for projecting a long rod at high velocity with enhanced penetrating energy. The high explosive assembly has an elongated core of a first high explosive having a first Chapman-Jouguet detonation velocity, an elongated liner positioned substantially along the longitudinal axis of the core, and an elongated jacket of a second high explosive encasing the core and having a second Chapman-Jouguet detonation velocity greater than the core Chapman-Jouguet detonation velocity. The jacket high explosive, upon detonation, continuously initiates detonation of the core high explosive by an imposed oblique detonation front which converges toward the center of the detonating core with time, until a trailing mach stem emerges therefrom as detonation progresses. The mach stem grows with time as the detonation continues until a steady state mach stem disk results, and detonation proceeds further as a highly overdriven detonation of the core to expel the liner as a long rod at high velocity.

20 Claims, 2 Drawing Sheets

HIGH EXPLOSIVE ASSEMBLY FOR PROJECTING HIGH VELOCITY LONG RODS

BACKGROUND OF THE INVENTION

The present invention relates to a high explosive assembly for ejecting a penetrating projectile at high velocity. More particularly, the present invention relates to a liner and jacketed high explosive configuration for projecting high velocity long rods.

A method to achieve higher long rod velocities without using liner jetting phenomena has long been sought. The term "long rod" is generic for any projectile with a long length to diameter ratio. Penetrating projectiles are often designed to be ejected upon detonation by the chemical energy of an energetic material, such as a high explosive. The "liner" refers to the material which forms the penetrator prior to detonation of the high explosive.

Methods to accelerate liners to higher velocities have been investigated since the advent of high explosive metal accelerating devices in the early 1900's. Normally, convergence effects of the liner are used to produce jetting of the liner material by means of a shaped charge. These effects produce very high velocities for a small fraction of the total liner mass. This small fraction is commonly called the shaped charge jet. A larger piece, commonly called the slug, achieves a lower velocity. The shaped charged jet which achieves a high velocity has a large penetration capability, while the large slug which follows at lower velocity generally does not.

Methods that accelerate the entire liner mass with a single explosive are commonly referred to as explosively formed penetrators. These methods achieve much lower velocities for the long rod than can be achieved from the jetting effects of a shaped charge.

It is an object of the present invention to provide a method and a high explosive configuration for producing long rods with velocities which exceed the capability of explosively formed penetrators.

It is a further object of the present invention to provide a method and a high explosive configuration for producing long rods with high velocities without resorting to the jetting effects of shaped charge warheads, and their attendant sensitivity to fabrication details.

These and other objects of the invention, as well as the advantages thereof, will become clear from the disclosure which follows.

SUMMARY OF THE INVENTION

The liner and jacketed explosive configuration of the present invention is able to achieve long rod velocities which have previously been unattainable except by liner jetting. This new method uses convergence effects in the high explosive to achieve the high velocities, whereas traditional methods of achieving high velocities use convergent effects in the liner by means of shaped charges.

The explosive configuration for the present invention includes a high explosive core, a liner positioned along an axis of the core, and a high explosive jacket encasing the core. The high explosive assembly can either be pressed and machined or it may be cast to the desired arrangement of core and jacket. It is important that the outside high explosive of the jacket have a higher Chapman-Jouguet detonation velocity than that of the inside explosive of the core. The explosive can be confined or unconfined, although as explained hereinafter, it is desirable to have some confinement on the flat explosive surface on which the liner sits.

Detonation of the high explosive is initiated at one end of the high explosive assembly. Upon detonation, the outside explosive of the jacket continuously initiates detonation of the inside explosive of the core, thereby creating an oblique detonation front within the inside explosive of the core. After some time, the oblique detonation front converges upon itself and forms a detonation mach stem within the core as the detonation proceeds along the high explosive assembly. The detonation mach stem is a highly overdriven detonation with an ultra-high detonation pressure and a high localized available energy density. After some further time, a steady state detonation mach stem is formed as the detonation progresses along the high explosive assembly. As the detonation wave passes down the explosive, the liner is accelerated from the explosive surface of the disk of the mach stem. When the liner has been completely accelerated, a high velocity long rod results.

Accordingly, in one aspect, the present invention comprehends a method for projecting a long rod at high velocity from a high explosive assembly which includes the steps of: a) providing a core of a first high explosive having a first Chapman-Jouguet detonation velocity b) providing a liner positioned substantially along an axis of the core; c) providing a jacket of a second high explosive encasing the core and having a second Chapman-Jouguet detonation velocity greater than the first Chapman-Jouguet detonation velocity; d) initiating detonation of the core and the jacket at a detonation initiating end of the core and jacket; e) continuing to detonate the jacket high explosive and thereby continuously initiating detonation of the core high explosive by an imposed oblique detonation front which converges toward the center of the detonating core with time; f) continuing the detonation until the converging imposed oblique detonation front produces a trailing mach stem as detonation progresses; g) continuing the detonation for a time sufficient to allow the mach stem to grow until a steady state mach stem disk results; h) continuing the detonation further with the steady state mach stem disk providing a highly overdriven detonation of the core; and, i) expelling the liner as a long rod at high velocity.

In another aspect, the present invention comprehends a high explosive assembly, suitable for use in projecting long rods at high velocity, which includes: a) a core of a first high explosive having a first Chapman-Jouguet detonation velocity; b) a liner positioned substantially along an axis of the core; and, c) a jacket of a second high explosive encasing the core and having a second Chapman-Jouguet detonation velocity greater than the first Chapman-Jouguet detonation velocity, the jacket high explosive upon detonation continuously initiating detonation of the core high explosive by an imposed oblique detonation front which converges toward the center of the detonating core with time until a mach stem emerges as detonation progresses, the mach stem growing with time as the detonation continues until a steady state mach stem disk results and detonation proceeds further as a highly overdriven detonation of the core to expel the liner as a long rod at high velocity.

A clearer understanding of the present invention will be obtained from the disclosure which follows when read in light of the accompanying drawings.

DESCRIPTION OF THE PREFERRED EMBODIMENT

Figure 1:
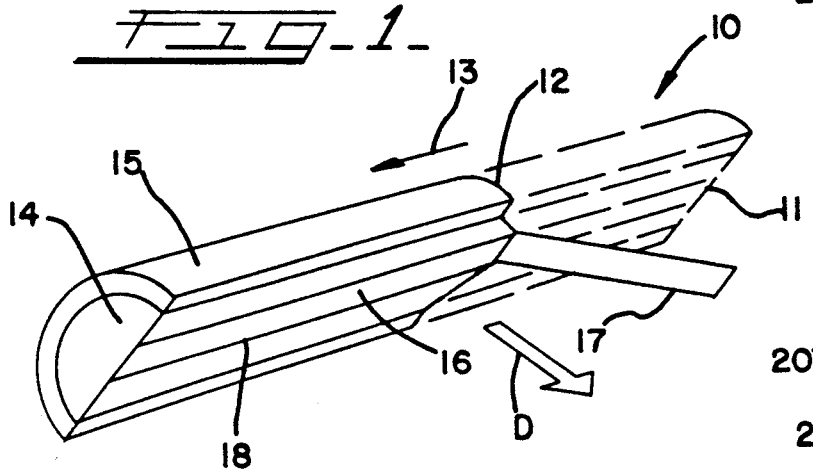
FIG. 1 is a simplified schematic perspective view of one embodiment of the high explosive assembly of the present invention.

Referring now to FIG. 1, there is shown a simplified schematic perspective view of one embodiment of the high explosive assembly 10 of the present invention. The high explosive assembly 10 is shown having the shape of one-half of a right circular cylinder having a detonation initiation first end 11. As detonation progresses along the length of the high explosive assembly 10, a detonation front 12 develops. The detonation front 12 is shown as a solid line and those portions of the high explosive assembly which have detonated are shown by means of elongated dashed lines. The detonation travels longitudinally in the direction which is shown by the detonation arrow 13. The high explosive assembly contains a core 14 of high explosive having a first Chapman-Jouguet detonation velocity. A jacket 15 of high explosive having a second Chapman-Jouguet detonation velocity, which is greater than the first Chapman-Jouguet detonation velocity of the core explosive, encases the outer surface of the high explosive core 14.

Axially located within the core 14 is an elongated liner 16 which conventionally is made of a metallic material. Liner 16 has a first end 17 and a second end 18. The first end 17 is shown oblique or kinked due to the effects of the detonation of the initiating end of the high explosive assembly 10. The kinking occurs because the second end of the high explosive assembly has not yet been detonated sufficiently so that the second end 18 of the liner 16 remains stationary until the liner is finally expelled as a projectile from the detonating core explosive. When the liner 16 is expelled from the high explosive detonation, the liner exits as a high velocity long rod, and the force is sufficient to straighten out the first end 17 and the second end 18 so that the long rod has a substantially linear configuration.

Figure 7:
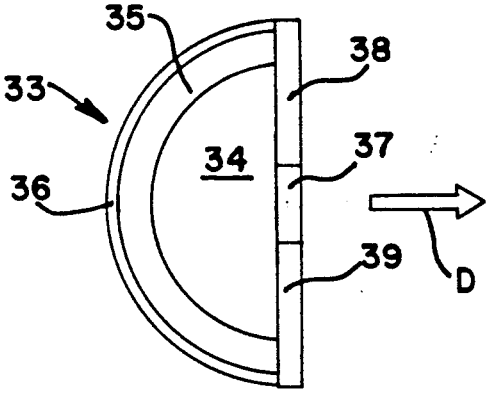
FIG. 7 is a simplified schematic representation of the end elevation of a further embodiment of the present invention.

The long rod leaves the detonating explosive at high velocity with high penetrating energy in the direction of the arrow D. The direction of flight of the long rod, as shown by arrow D, is perpendicular to the longitudinal axis or cylindrical axis of the right circular cylindrical configuration of the jacketed high explosive. The first end 17 of the liner becomes the leading end of the high velocity long rod and the second end 18 of the liner becomes the trailing end of the high velocity long rod. Further disclosure concerning the high velocity long rod will be found hereinafter when FIG. 7 is discussed.

Figure 2:
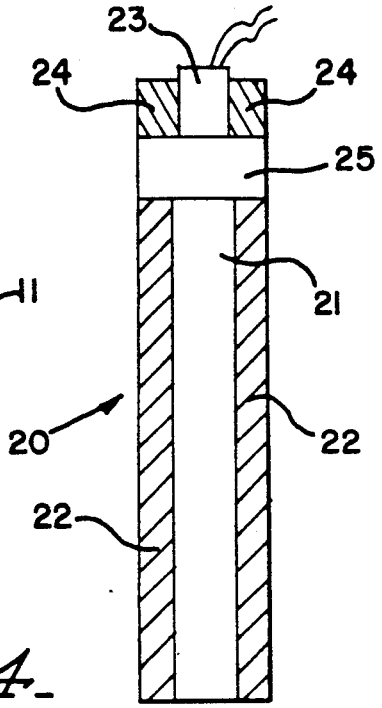
FIG. 2 is a simplified schematic front elevational view of another configuration of a jacketed high explosive which was used in testing for the development of a steady state mach stem.

FIG. 2 is a simplified schematic front elevational view of another configuration of jacketed high explosive which was used in testing for the development of a steady state mach stem. Referring now to FIG. 2, an explosive assembly 20 contains a cylindrical core 21 of high explosive in the configuration of a right circular cylinder. An annular jacket 22 of high explosive encases the right circular cylindrical core 21 of the assembly. An electric detonator 23 is positioned at the top of the assembly and confined within a retaining ring 24. A booster explosive 25 is positioned between the detonator and the core and jacket of the assembly.

For the test work which was conducted in the study of the development of a steady state mach stem, the cylindrical core 21 contained a high explosive of TNT surrounded by a cylindrical jacket of a more energetic high explosive, PBX9501. PBX9501 contains 95% of HMX and 5% of a binder. The external diameter of the jacket of PBX9501 was 19 mm and the external diameter of the core of TNT was 12.7 mm. Thus, the thickness of the jacket was about 3.15 mm. The density of the TNT core was 1.56 grams per cc and the density of PBX9501 jacket was about 1.66 grams per cc. These densities are the actual densities of the compressed explosives which were pressed into the cylindrical shape forming the high explosive assembly of FIG. 2.

Figure 3:
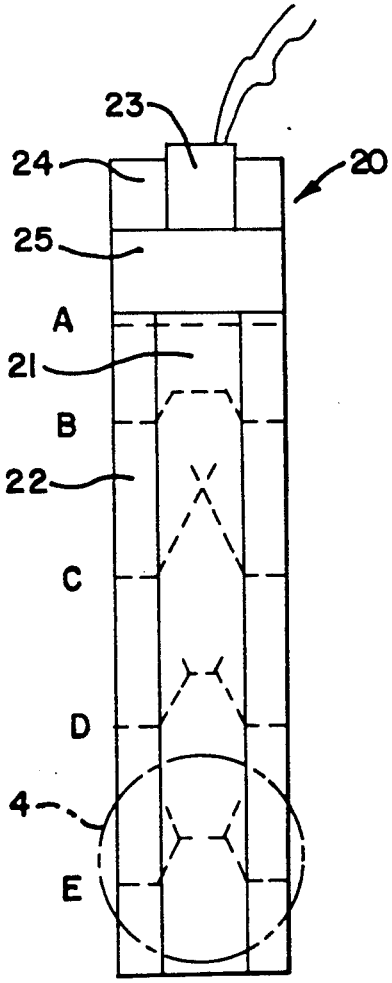
FIG. 3 is a simplified schematic front elevational view of the high explosive assembly of FIG. 2, showing the progression of detonation and the development of a steady state mach stem.

FIG. 3 illustrates the progression of a detonation within the high explosive assembly of FIG. 2. FIG. 3 illustrates the classical transition from a circular planar detonation front at the initiation end of the high explosive assembly 20 to a final idealized mach stem form. By this classical treatment, if the arrangement is plane initiated at one end, as shown at step A of FIG. 3, a steady mach stem detonation front can form sometime after initiation. Two stages are passed through during the steady state mach stem formation. In the first stage, the more energetic jacket explosive 22 continuously initiates the inside high explosive 21 of the core, causing an oblique detonation front to form, as shown at Step B in FIG. 3. The oblique detonation front converges at the center of the core 21, thereby causing a trailing reflected shock wave to emerge as seen at Step C of FIG. 3. By classical treatment, if the convergence angle is beyond the critical angle for regular reflection, a mach stem will grow as shown at Step D of FIG. 3. After some time a steady state mach stem is achieved as indicated at Step E. The resulting mach stem disk is a highly overdriven detonation.

Figure 4:
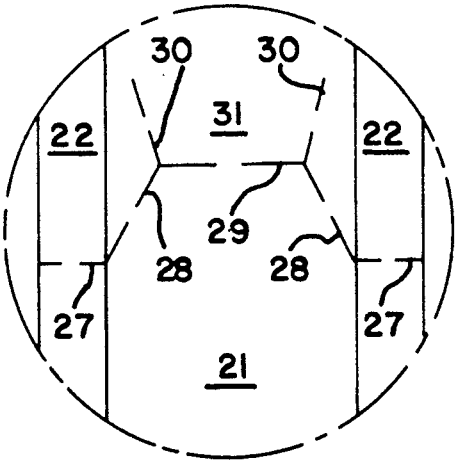
FIG. 4 is a simplified schematic representation of the steady state mach stem of FIG. 3, as seen within viewing circle 4 of FIG. 3, and enlarged for purposes of clarity.

FIG. 4 provides a simplified schematic representation of the idealized steady state mach stem of FIG. 3, as seen within viewing circle 4 of FIG. 3, with FIG. 4 being enlarged for purposes of clarity. FIG. 4 shows that the jacket 22 has a jacket detonation front 27 which causes an oblique detonation front 28 to form behind the jacket detonation front 27 within the core explosive 21. A mach stem disk 29 is formed within the core explosive 21 and a reflected shock wave 30 trails behind. A region 31 of very high pressure is concentrated behind the mach stem disk 29. The detonation mach stem disk 29 is a highly overdriven detonation, with an ultra-high detonation pressure and a high localized available energy density located in region 31 behind the disk 29. This ultra-high pressure and high available energy density are used to accelerate liners to a very high long rod velocity in the present invention.

High explosive detonation mach stem phenomena are a relatively new research area which has been studied only since the early 1960's Although non-steady state mach stems in gases have been studied extensively, steady state mach stems have been largely ignored, particularly in high explosives. Nonetheless, steady state detonation mach stems are of great interest due to the observability of continuous highly overdriven detonations. Although non-steady growth theory exists, no analytic theory currently existed at the time of the test work to predict the rate of mach stem growth to a steady state or the final steady state mach stem configuration size. However the state directly behind the overdriven mach stem disk can be calculated by using the Chapman-Jouguet detonation velocity of the jacket explosive for the overdriven detonation velocity of the core explosive. The computer program TIGER was used with BKW equation of state and BKWR parameters to calculate the Chapman-Jouguet states of TNT and PBX9501. The PBX9501 Chapman-Jouguet detonation velocity was used to calculate the overdriven state of a TNT mach stem disk. The results are presented in Table I.

Several things become apparent from the data presented in Table I. Note that the detonation velocity of the core TNT is 6.847 Km/s, whereas the detonation velocity of the overdriven TNT is 8.409 Km/s, which is the same as the Chapman-Jouguet detonation velocity of the jacket PBX9501. This is because the Chapman-Jouguet detonation velocity for the jacket was used for the overdriven mach stem disk velocity as a basis for the calculations. It will be seen that the calculated pressure in the detonation of the overdriven TNT is 491.4 Kb in comparison to 179.9 Kb in the conventional detonation of TNT. Moreover, this overdriven pressure exceeds the detonation pressure of 291.7 Kb for the Jacket PBX9501. It is this ultra-high pressure which is created behind the steady state mach stem disk which provides the high energy for ejecting the liner in the present invention to provide a high velocity long rod.

TABLE I

| | TIGER Calculations | | |
|---|---|---|---|
| | PBX9501 | TNT | TNT (Overdriven) |
| $_o$, g/cc | 1.66 | 1.56 | 1.56 |
| $D_{cj}$, Km/s | 8.409 | 6.847 | 8.409 |
| $U_{cj}$, Km/s | 2.089 | 1.684 | 3.760 |
| $_{cj}$, g/cc | 2.209 | 2.069 | 2.822 |
| $P_{cj}$, Kb | 291.7 | 179.9 | 491.4 |

$_o$: original density of pressed explosive
$D_{cj}$: detonation velocity of the explosive
$U_{cj}$: particle velocity
$_{cj}$: density under normal detonation condition
$P_{cj}$: pressure generated by detonation In order to gain a better understanding of steady state detonation mach stem formation and structure, a flow field analysis was done by numerically solving the two dimensional axisymmetric non-steady conservation equations for the explosive assembly illustrated in FIGS. 2 and 3.

To verify computational results, two types of experiments were performed. The first type of experiment consisted of taking flash radiographs of detonation fronts. Low energy "soft" x-rays were under in order to capture the mach stem wave form. The second type of experiment consisted of taking high speed photographs of the detonation wave form as it emerged from the charge base, using a multi-slit technique.

A comparison was made between measured and computed mach stem forms. The flash radiograph trace was at the same distance from the initiation surface (about 34 mm) as the computed pressure plot of the steady state mach stem. The multi-slit steady state detonation wave form result was for a 3 inch tall charge. The forms agreed very well.

Figure 5:
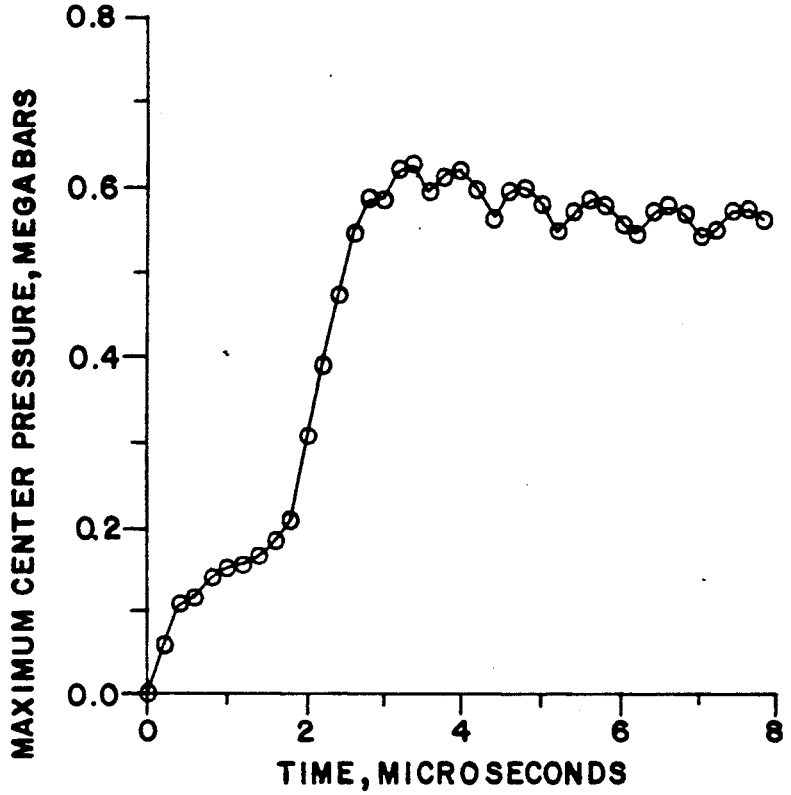
FIG. 5 is a plot of the detonation of FIG. 3 showing maximum center pressure plotted against time.
Figure 6:
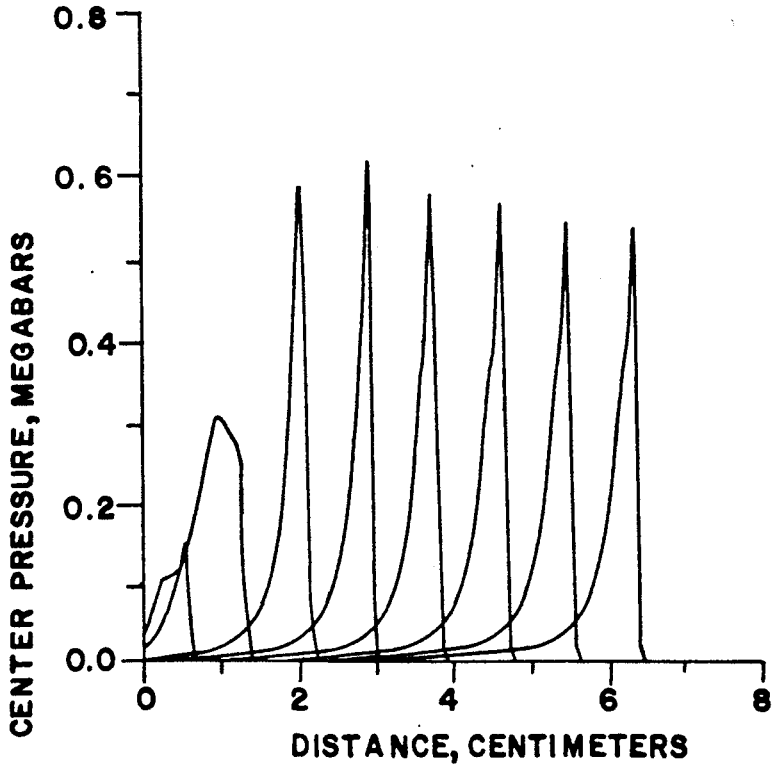
FIG. 6 is a plot of the detonation of FIG. 3 showing center pressure profiles at one microsecond intervals.

The change of the TNT axial detonation from a Chapman-Jouguet detonation to an overdriven detonation can be observed from the center pressure profiles at 1 microsecond intervals as shown in FIG. 6. At 1 microsecond a TNT Chapman-Jouguet detonation exists. At 2 microseconds a transition is taking place. By 3 microseconds a highly overdrive detonation exists, but maximum pressure is slightly behind the detonation front. After about 4 microseconds, the mach stem form reaches a quasi-stable state and does not change substantially, as shown in FIG. 5.

The computed and experimentally derived steady state mach stem forms agreed very closely. In all cases, a curved mach stem disk was observed and not a classical idealized flat disk.

Steady state mach stem formation and structure in condensed explosives is an interesting phenomenon that has received attention only recently. The prior studies experimentally analyzed the phenomenon and had some mathematical treatment, but no flow field analysis was included. The above summarized test work, addresses the formation and structure of steady state mach stems for similar energetic material geometry as the earlier studies, but includes a numerical flow field analysis. The flow field analysis revealed several differences between actual axisymmetric steady state detonation mach stems and the classical idealized triple shock configuration. These differences include overdriven detonation before center convergence, a curved mach stem disk, and a complex flow with rarefaction effects instead of a reflected shock wave.

The high explosive assembly which was used for these tests, as shown in FIGS. 2, 3, and 4, did not contain a liner axially disposed within the right circular cylindrical structure of the high explosive assembly, since that was not a purpose for the study. Therefore, in order to find a practical use for the observed phenomenon, additional tests were conducted to determine the performance of a liner axially disposed in a jacketed high explosive assembly which develops a steady state mach stem. The structure of this high explosive assembly is illustrated in FIG. 7.

The configuration of the jacketed high explosive was that of one-half of a right circular cylinder. Explosive assembly 33 was fabricated for testing a high velocity long rod by pressing a right circular cylindrical core of high explosive 34 with a high explosive jacket 35 into a packing device or casing 36, which was made of one-half of a plastic tube. Liner 37 was positioned longitudinally and axially at the anticipated convergence point (the cylindrical axis) of the oblique detonation front 28 created by the jacket detonation front 27, as illustrated in FIGS. 3 and 4. An upper cover plate 38 and a lower cover plate 39 were also placed on the flat rectangular surface of the one-half cylinder, as seen in FIG. 7. The cover plates minimized the loss of high pressure gas upon detonation of the high explosive assembly. The liner and cover plates were made of copper. Detonation caused the liner 37 to be expelled forward at a high velocity with high penetrating capability as a high velocity long rod. Both cover plates were also expelled forward upon detonation, but at a lower velocity than the liner. The velocity of the cover plates was such that they would have no penetration effect.

The high velocity long rod and the cover plates were expelled forward in the direction of the arrow D of FIG. 7. This direction is perpendicular to the longitudinal axis or cylindrical axis of the one-half of the right circular cylinder of the jacketed high explosive assembly, as previously discussed in regard to FIG. 1. Determination of velocity and performance of the liner and cover plates was by means of flash x-ray photography. The test work showed that the long rod traveled along the flight path in the direction of the arrow D, but oriented at an acute angle to the direction of flight (arrow D). Additionally, the work showed that the long rod did not spin end over end, but remained stable in flight at the acute angle. The full information concerning this test work, which was considered to be successful, is fully documented in the U.S. Army ARDEC laboratory notebook AEE-88-0010, used by Ernest L. Baker at Picatinny Arsenal.

The explosive configuration for the inventive high explosive assembly can either be pressed and machined, or it may be cast to the desired core and jacket arrangement. It is important that the outside explosive of the jacket have a higher Chapman-Jouguet detonation velocity than the Chapman-Jouguet detonation velocity of the core explosive. The explosive can be confined or unconfined. It is desirable to have some confinement on the flat explosive surface on which the liner sits, as has been illustrated in FIG. 7, where an upper and a lower cover plate were utilized. This confinement can be very thin, but it should be of a material which has a higher density than that of the explosives.

The liner should be in direct contact with the explosives, or there may be a thin layer of grease or sealant between the liner and the explosives. The liner can be composed of any desired material and it can be tapered from end to end. The taper may be of the thickness or it may be a taper of the width. The liner should be positioned in the jacketed high explosive assembly of this invention so that the narrowest end of the taper becomes the forward end of the long rod when the liner is expelled as a high velocity long rod. For the high explosive assembly of FIGS. 1 and 7, the liner should be oriented so that the narrowest tapered end is proximate the detonation end of the assembly. The liner should be of a width which is smaller than the explosive surface, as shown in FIG. 7, but the width does not need to be constant. If the liner is tapered in width the cove plates should be tapered in width in the opposite direction. The liner geometry affects the final long rod velocity and direction of travel. The liner configuration may be that of a strip or ribbon, as shown in FIGS. 1 and 7, or it may be that of a narrow cylindrical rod.

The actual configuration of the high explosive assembly and the liner will, of course, depend upon the environment of use. For example, a high explosive assembly of the present invention which is used for the penetration of armored vehicles, may have a configuration which is completely different from the configuration of a high explosive assembly of the present invention which is used for the penetration of the steel casing of an oil well. Such alternative configurations for the jacketed high explosive assembly of this invention have not yet been established.

The foregoing disclosure and drawings are merely illustrative of the principles of this invention and are not to be interpreted in a limiting sense. We wish it to be understood that we do not desire to be limited to the exact details of construction shown and described because obvious modifications will occur to a person skilled in the art.

The invention claimed is:

1. An explosive assembly, suitable for use in projecting long rods at high velocity, which comprises:
   a) a core of a first high explosive having a first Chapman-Jouguet detonation velocity;
   b) a liner positioned substantially along an axis of said core; and
   c) a jacket of a second high explosive encasing said core and having a second Chapman-Jouguet detonation velocity greater than said first Chapman-Jouguet detonation velocity, said jacket high explosive upon detonation continuously initiating detonation of said core high explosive by an imposed oblique detonation front which converges toward the center of said detonating core with time until a trailing mach stem emerges therefrom as detonation progresses, said mach stem growing with time as said detonation continues until a steady state mach stem disk results and detonation proceeds further as a highly overdriven detonation of said core to expel said liner as a long rod at high velocity.

2. An explosive assembly according to claim 1 wherein the wall thickness of said encompassing jacket is substantially less than the thickness of said core.

3. An explosive assembly according to claim 1 wherein said core, said liner and said jacket are each elongated.

4. An explosive assembly according to claim 3 wherein said axis is a longitudinal axis.

5. An explosive assembly according to claim 1 wherein said axis is a longitudinal axis.

6. An explosive assembly according to claim 1 wherein said liner is expelled in a direction substantially perpendicular to said axis.

7. An explosive assembly according to claim 1 wherein said core is shaped substantially in the form of one-half of a circular cylinder having a flat surface at the cylindrical axis.

8. An explosive assembly according to claim 7 wherein said encasing jacket is shaped substantially in the form of one-half of an annular circular cylinder encompassing the cylindrical surface of said core.

9. An explosive assembly according to claim 8 wherein the wall thickness of said encompassing jacket is substantially less than the diameter of said core.

10. An explosive assembly according to claim 7 wherein the longitudinal axis of said core is in the center of the flat surface of said one-half of the circular cylinder and said liner is centrally positioned at said flat surface.

11. An explosive assembly according to claim 10 wherein a cover plate is positioned on said flat surface on each side of said liner.

12. An explosive assembly according to claim 1 wherein said liner is tapered from end to end with the narrowest part of the taper oriented to become the forward end of the high velocity long rod upon detonation of said explosive assembly.

13. An explosive assembly according to claim 12 wherein said liner comprises a strip tapered in thickness.

14. An explosive assembly according to claim 12 wherein said liner comprises a strip tapered in width.

15. An explosive assembly according to claim 1 wherein a detonator is positioned at a first end of said core and said encasing jacket.

16. An explosive assembly according to claim 15 wherein a booster explosive charge is positioned at said first end between said detonator and said core and encasing jacket.

17. A method for projecting a long rod at high velocity from a high explosive assembly which comprises:

a) providing a core of a first high explosive having a first Chapman-Jouguet detonation velocity;

b) providing a liner positioned substantially along an axis of said core;

c) providing a jacket of a second high explosive encasing said core and having a second Chapman-Jouguet detonation velocity greater than said first Chapman-Jouguet detonation velocity;

d) initiating detonation of said core and said jacket at a detonation initiating end of said core and jacket;

e) continuing to detonate said jacket high explosive an thereby continuously initiating detonation of said core high explosive by an imposed oblique detonation front which converges toward the center of said detonating core with time;

f) continuing said detonation until said converging imposed oblique detonation front produces a trailing mach stem as detonation progresses;

g) continuing said detonation for a time sufficient to allow said mach stem to grow until a steady state mach stem disk results;

h) continuing said detonation further with said steady said core; and, i) expelling said liner as a long rod at high velocity.

18. A method according to claim 17 wherein said core, said liner and said jacket have an elongated configuration.

19. A method according to claim 17 wherein said axis is a longitudinal axis.

20. A method according to claim 17 wherein said core is shaped substantially in the form of one-half of a circular cylinder having a flat surface at the cylindrical axis, said liner is positioned along the cylindrical axis at said flat surface, and said jacket is shaped substantially in the form of one-half of an annular circular cylinder encompassing the cylindrical surface of said core.

* * * * *